United States Patent [19]

Sukolics

[11] 4,141,188

[45] Feb. 27, 1979

[54] WALL CONSTRUCTION

[75] Inventor: Ronald D. Sukolics, St. Louis, Mo.

[73] Assignee: Kawneer Company, Inc., Niles, Mich.

[21] Appl. No.: 876,666

[22] Filed: Feb. 10, 1978

[51] Int. Cl.[2] ..... E04B 2/88; E04H 1/00

[52] U.S. Cl. ..... 52/395; 52/772; 52/775; 49/DIG. 1; 52/730

[58] Field of Search ..... 52/395, 397–401, 52/775, 781, 235, 664, 772, 456, 475, 476, 208, 730–732; 49/DIG. 1, DIG. 2

[56] References Cited

U.S. PATENT DOCUMENTS

| | | | |
|---|---|---|---|
| 2,575,655 | 11/1951 | Clerk | 52/398 |
| 3,037,591 | 6/1962 | Pulling et al. | 52/397 |
| 3,053,353 | 11/1962 | Miller | 52/456 |
| 3,081,849 | 3/1963 | Hubbard | 52/475 |
| 3,147,518 | 9/1964 | Horgan | 52/397 |
| 3,527,011 | 9/1970 | Bloom et al. | 52/476 |
| 3,553,918 | 1/1971 | Dauson | 52/208 |
| 3,978,629 | 9/1976 | Echols | 52/395 |

FOREIGN PATENT DOCUMENTS

| | | | |
|---|---|---|---|
| 1940791 | 2/1971 | Fed. Rep. of Germany | 49/DIG. 1 |

*Primary Examiner*—James L. Ridgill, Jr.

*Attorney, Agent, or Firm*—Mason, Kolehmainen, Rathburn & Wyss

[57] ABSTRACT

A wall construction includes a framework of mullions supporting one or more glazing panels and the mullions comprise an elongated inside member having an outwardly facing outer wall with an inwardly extending portion offset from the center of the outside wall which is formed with a longitudinal recess in an outer face thereof. An elongated glazing element having an outer wall spaced outwardly of the outer wall of the inside member is provided to form one or more glazing pockets on laterally opposite sides of the mullion for receiving the edge portions of the glazing panels. The glazing element includes a tongue extending inwardly from the outer wall toward the recess in the inside vertical structural member. Fastening means is provided for securing the outside glazing element and the inside structural member together from the inside of the building and includes insulating spacer blocks seated in the recess and extending into a groove in the tongue of the glazing member with the sealed fasteners. The glazing panels are installed from the inside and are secured with their edge portions in the glazing pockets formed by the assembly of the inside member and the glazing element of the mullions.

20 Claims, 17 Drawing Figures

WALL CONSTRUCTION

BACKGROUND OF THE INVENTION

1. Field of the Invention

The present invention relates to a new and improved wall construction and more particularly, relates to a wall construction employing elongated vertical and horizontal frame members forming a framework for supporting one or more glazing panels installed from the inside.

2. Description of the Prior Art

In the U.S. Pat. No. 3,037,591 which issued June 5, 1962 there is disclosed a wall construction wherein prefabricated panel assemblies including peripheral framing members attached around the edges of glazing panels are initially constructed or fabricated at a factory or the like and then are shipped as a package to a construction site for installation in a building structure to form a curtain wall. The wall construction therein shown, emphasized the prefabricated nature of the process before installation at the job site and the styling of the finished wall construction emphasized strong, deep, shadow lines in that the glazing panels are spaced an appreciable distance inwardly from the outer surface portions of the framing members. In U.S. Pat. No. 3,719,014, there is shown another wall system which reflects a changing trend from prefabricated or factory built units to wall systems that are fabricated initially and constructed at the building site. One of the main reasons for the changing trend is the design and size constraints that are imposed by the factory built or prefabricated approach which make it increasingly difficult to meet the higher air and water filtration standards that are becoming code requirements. In the U.S. Pat. No. 3,797,191, issued Mar. 19, 1974, there is illustrated yet another type of wall construction wherein a flush grid appearance is emphasized and in this type of wall construction, tinted heat absorbing and reflective glass is often used with resultant thermal shock problems caused when strong shadows are present. In addition, the flush grid appearance type systems almost universally require glazing from the outside and, consequently, economic considerations became controlling because of the high cost of erecting outside scaffolds and the like.

Accordingly, it is an object of the present invention to provide a new and improved wall construction which eliminates or greatly reduces the problems associated with the aforementioned wall systems.

More particularly, it is an object of the present invention to provide a new and improved wall construction which provides a flush grid appearance yet one which is relatively simple, easily erected, and which can be glazed from the inside and in addition provides outstanding weathering performance, in terms of minimizing air and water infiltration.

Another object of the present invention is to provide an inside glazed wall construction of the character described which provides a thermal break or insulation in the frame member between an inside member and an outside glazing element.

Yet another object of the invention is to provide a new and improved mullion system for a wall construction, which mullion system is readily adapted to accept both single and double thickness glazing panels with a minimum amount of conversion being required.

Yet another object of the present invention is to provide a new and improved mullion system of the character described which is adapted to be assembled and glazed from the inside by workmen, supported on the floor structure of the building.

Yet another object of the present invention is to provide a new and improved mullion system of the character described having extremely good weathering characteristics for minimizing the infiltration of air and water from the outside.

Yet another object of the present invention is to provide a new and improved building wall construction of the character described which is capable of being erected and glazed from the inside of a building without the use of exterior scaffolding and yet which is capable of reglazing from outside of the building should glass breakage occur.

Another object of the invention is to provide a new and improved building wall construction of the character described which presents a neat and trim appearance from both the inside and outside and which is capable of interfacing well with interior ceilings, curtain recesses, heating-ventilating cooling units, and the like.

Yet another object of the invention is to provide a new and improved building wall construction wherein a framework of vertical and horizontals is formed of interconnected, heat insulating frame members in a manner minimizing heat transfer between inside and outside portions of the frame members.

Still another object of the invention is to provide a new and improved building wall construction of the character described wherein inside elements of parallel frame members run past outside elements of transversely extending parallel frame members and vice versa.

SUMMARY OF THE INVENTION

The foregoing and other objects and advantages of the present invention are accomplished in an illustrated embodiment comprising a new and improved building wall construction which includes a novel mullion system for supporting one or more glazing panels in a wall framework of transversely intersected framing members. The mullions include an inside, elongated member having an outwardly facing outer wall and an inside wall portion is eccentric of a center line of the outer wall. The outer wall is formed with an elongated recess in an outer face and an elongated glazing element with an outer wall parallel of the outwardly facing wall on the inside member is assembled therewith to form one or more laterally oppositely facing glazing pockets adapted to receive the adjacent edge portions of glazing panels and the like which are installable from the inside of the building. The glazing element of the mullions includes an inwardly directed flange which is secured to the inside member with hear insulating spacer blocks and threaded fasteners which are tightened from the inside.

In erecting the wall construction in accordance with the invention, the vertical inside members are first cut to length and are erected and secured in place to the building structure. The outside horizontal glazing elements are secured in place to run past the vertical inside elements on chairs so that the framework comprises inside vertical elements running past outside horizontal elements.

Between the outside horizontal glazing elements outside glazing elements are attached with the threaded fasteners and spacer blocks and this is done from the inside to form the vertical glazing pockets. The fastener heads are passed through keyhole shaped holes formed at appropriate intervals on the outer wall of the vertical inside elements and the outside vertical elements are moved downwardly until the fastener shanks extend loosely through the smaller end portions of the openings. Similarly, the inside horizontal elements are attached to the continuous outside horizontal glazing elements between the vertical inside elements to form the horizontal glazing pockets. The glazing panels are then assembled into the glazing pockets and finally, the threaded fasteners are tightened from the inside of the inside members of the mullions to firmly secure closed the panels in place in the openings formed by the completed mullion framework structure.

BRIEF DESCRIPTION OF THE DRAWINGS

For better understanding of the present invention, reference should be had to the following detailed description taken in conjunction with the drawings, in which.

DESCRIPTION OF THE PREFERRED EMBODIMENTS

Figure 1:
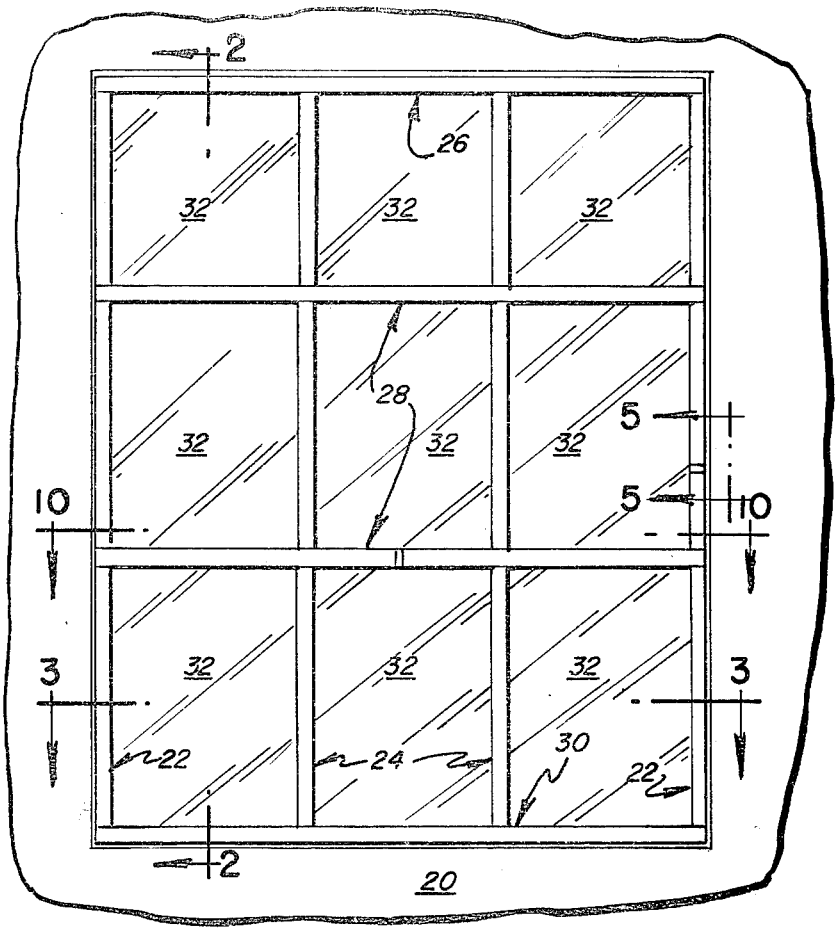
FIG. 1 is a front, elevational view of a new and improved wall construction incorporating the features of the present invention.

Referring now more particularly to the drawings, in FIG. 1 is illustrated a new and improved building wall construction in accordance with the features of the present invention referred to generally by the reference numeral 20. The new and improved wall construction includes a plurality of vertical upwardly extending, spaced apart, frame members including jambs and mullions 22 and 24 which are interconnected adjacent their upper ends by a horizontally extending mullion or head 26. The wall construction also includes one or more intermediate horizontal mullions 28 spaced downwardly of the upper head and the vertical members are interconnected adjacent their lower ends by a horizontal mullion or sill structure 30. A plurality of rectangular glazing panels 32 are mounted in and supported by the framework of transversely extending mullions of the wall structure 10 and preferably, the glazing panels are of the insulating type employing two glass panes with a dead air space therebetween although single thickness panels 32A (FIGS. 2 and 4) may be provided.

Figure 3:
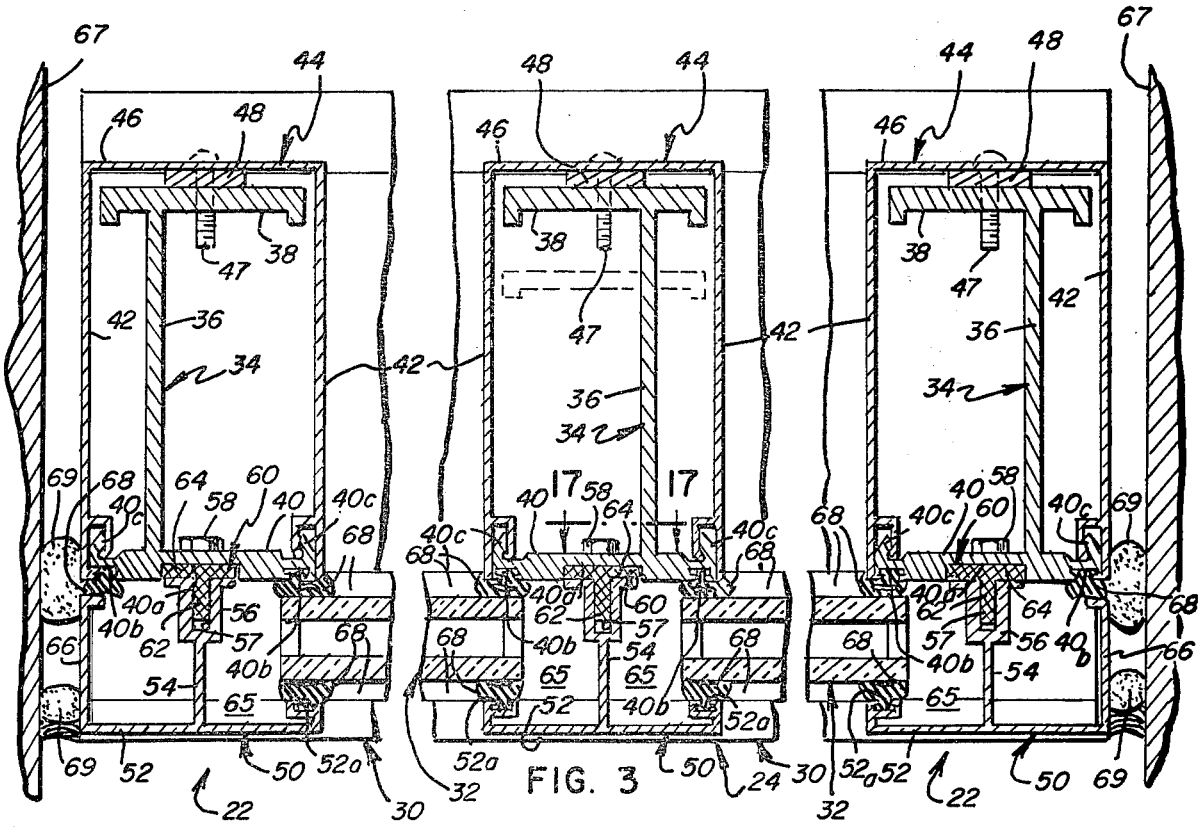
FIG. 3 is an enlarged, horizontal, sectional view taken substantially along lines 3—3 of FIG. 1.
Figure 4:
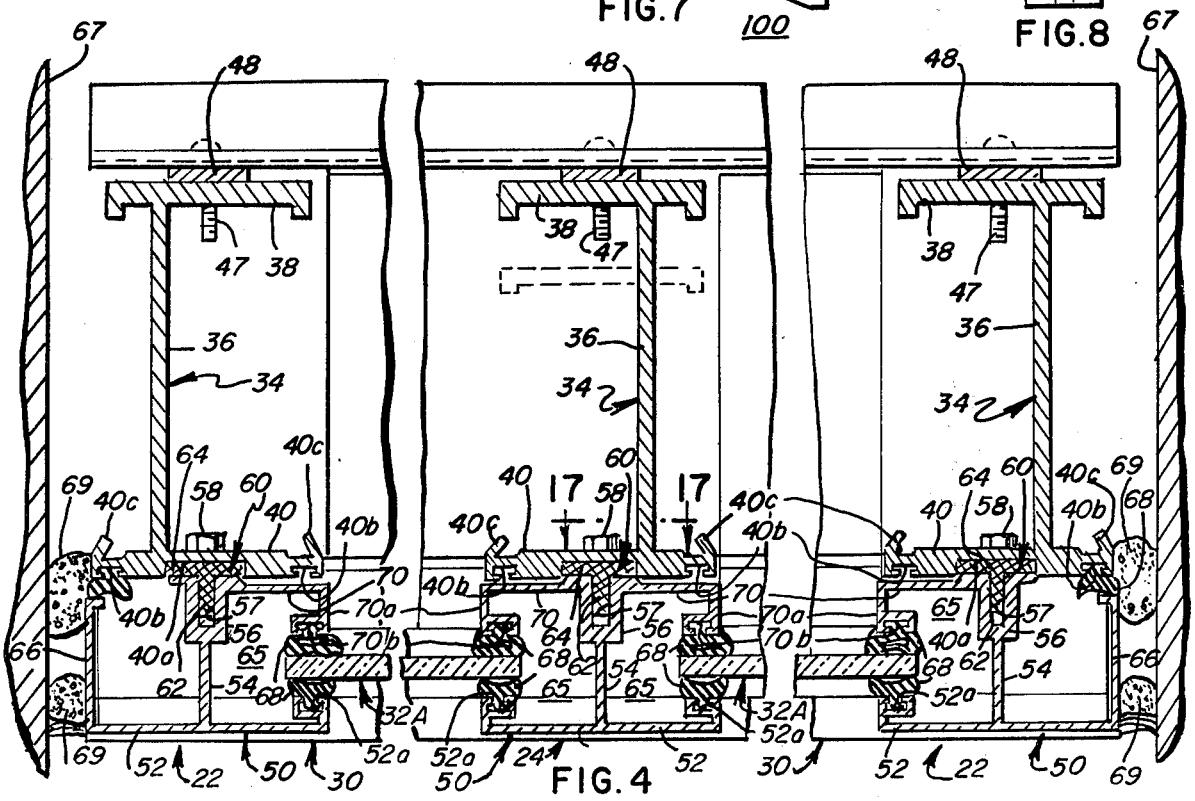
FIG. 4 is an enlarged, horizontal, sectional view similar to FIG. 3 and illustrating another embodiment of the invention.
Figure 17:
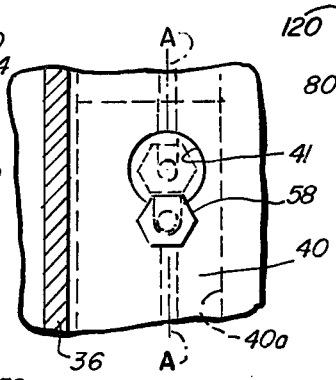
FIG. 17 is a fragmentary, vertical sectional view taken substantially along lines 16—16 of FIGS. 3 and 4.

Referring now to FIGS. 3, 4, 5 and 6, the vertical mullions 22 and 24 include an inside, elongated structural member 34 having a cross-section of a modified I-beam shape and preferably formed of extruded aluminum designed to carry the basic vertical load of the wall construction. The structural members 34 include an inwardly extending web 36 and a pair of transverse inside and outside flanges or walls 38 and 40 extending laterally along opposite edges of the web. As illustrated in FIGS. 3 and 4, the web 36 is offset to one side of the center line of the inside and outside walls 38 and 40 and along the center line on the outer walls (line A—A, FIG. 17) there is provided a plurality of vertically spaced apart keyhole shaped openings 41 at appropriate intervals. On the outwardly facing surface of the outer wall 40 there is formed a centrally aligned, longitudinally extending, relatively wide, channel-like groove **40*a* and this groove is flanked on opposite sides by a pair of outwardly spaced, smaller gasket or weatherstrip receiving grooves 40*b*. The keyhole openings 41 are aligned along the center axis A—A of the large central groove 40*a* as shown in FIG. 17. Along opposite edges, the outer wall 40 is provided with inwardly directed ridges 40*c* which are adapted to snappingly interlock with the outer edges on the opposite sidewall 42 of removable U-shaped covers 44 designed to enclose the I-beam shaped inside structural element 34. The covers provide a neat appearance and include a bight portion 46 which is secured to the inside flange or wall 38 with screw fasteners 47 extending through insulating spacer blocks 48 (FIG. 3**).

In accordance with the present invention, the vertical mullions 22 and 24 of the wall construction include elongated outer glazing elements 50 of generally T-shaped cross-section and these glazing elements have an outer wall or face member 52 parallel of the outer wall 40 of the inside structural members 34 and disposed to extend laterally outwardly on opposite sides of an inwardly directed tongue 54 having a relatively thick inside edge portion 56 defining a centrally disposed recess 57. The recess 57 is aligned with the center line A—A of the recess **40*a* and is adapted to receive the threaded shanks of a plurality of longitudinally spaced outwardly projecting cap screws 58 used for assembling together an inside vertical structural member 34 and an outer glazing element 50** as shown.

The keyhole, shaped openings 41 (FIG. 17) have enlarged upper end portions dimensioned to pass or clear the hexagonal head of the cap screws 58 and the lower portion of the openings is dimensioned to pass the shanks of the cap screw but is smaller than the hexagonal head thereof.

At aligned, longitudinally spaced intervals, the outer glazing element 50 is provided with a plurality of T-shaped spacer blocks 60 formed of heat insulating material such as rigid plastic resin. The insulator blocks include an outwardly extending tongue 62 adapted to snugly fit within the recess 57 of the thickened inside edge portion 56 of the glazing elements 50. The insulator blocks may be continuous or preferably may be relatively short in length and are formed with a centrally disposed opening to accommodate the shank of a cap screw 58. The insulator blocks include a laterally extending flange or head portion 64 having a flat inside surface adapted to bear against the outwardly facing bottom wall of the large recess 40*a* in the outer wall 40 of the inside structural member 34. A pair of outwardly facing surfaces on the head flange 64 of the insulator blocks are provided on opposite sides of the tongue 62 and these surfaces are adapted to bear snugly against enlarged inner end surfaces formed on the thickened inside edge portion 56 of the outer glazing element 50. The threaded shanks of the cap screws 58 bite into the inside surfaces of the recess 57 on the outer glazing element making a strong, tight, structural interconnection between the inside structural member 34 and the outside glazing element 50. Preferably, the T-shaped spacers 60 and the cap screws 58 are attached on the glazing elements 50 at the factory and at the job site, after the inside structural members 32 have been erected, the outside glazing elements are then attached thereto by passing the hexagonal heads of the cap screws 58 through the upper end portions of the keyhole shaped openings 41 and the glazing elements are then moved downwardly until the shanks of the cap screws seat against the bottoms of the narrow portions of the keyhole shaped slots. The cap screws are subsequently tightened with wrenches which are applied to the hexagonal heads from one side of the webs 36. The outside glazing elements 50 with the T-shaped spacer blocks 60 and the cap screws 58 already installed thereon at the factory are rapidly assembled onto the outer walls 40 of the in place inside structural elements 34 and this is accomplished from the inside of a building and external scaffolding is not required.

The outer walls 52 of the outer glazing elements 50 on the mullions 24 are formed with a pair of continuous, elongated gasket or weatherstrip receiving grooves 52*a* along the outer edge portions 66 on the inside surface. These grooves 52*a* are aligned with and spaced opposite of the grooves 40*b* in order to receive elastomeric strip gaskets 68 provided on opposite sidewalls of a pair of glazing pockets 65 on laterally opposite sides of the tongue 54 which forms a dividing wall. These gaskets or strips bear against and support the glazing panels 32 with weathertight seals formed against the inner and outer surfaces of the respective glass panes.

Referring to FIG. 3, the jamb mullions 22 have a modified, outer glazing element 50 generally similar to the glazing elements of the intermediate mullions 24 except that because only one, rather than a pair of glazing pockets is required, an inwardly directed wall 66 is provided along the edge of the outer wall 52 adjacent the building structure as represented by the opening wall surface 67. The wall is parallel of the tongue 54 and is provided with an inturned lip along the inner edge facing the adjacent groove 40*b* to accommodate a sealing strip 68 therebetween. In addition, caulking material 69 is provided between the building surface 67 and the walls 66.

Referring to FIG. 4, when single thickness glazing panels 32A are installed instead of the much thicker insulating glazing panels 32 as shown in FIG. 3, in order to accommodate the reduced thickness, the glazing elements are provided with an inside wall 70 closely parallel of the outer wall 40 of the inside structural member 34. On the intermediate mullions 24, a pair of inside walls extend in laterally opposite directions from the inner edge of the tongue section 56 while on the jamb mullions 22, only one wall 70 is provided on the side opposite the closure wall 66. The walls 70 rather than the walls 40, form the inside walls of the glazing pockets 65 when single thickness panels 32A are used and along the outer edges, the walls are provided with outwardly extending portions 70*a* parallel of the tongue 54. At the outer edges, the portions 70*a* are formed with inturned edge portions having recesses 70*b* adapted to accommodate the weatherstrips or gasket strips 68 which bear against the inside surface of the single thickness glazing panels 32A.

Figure 5:
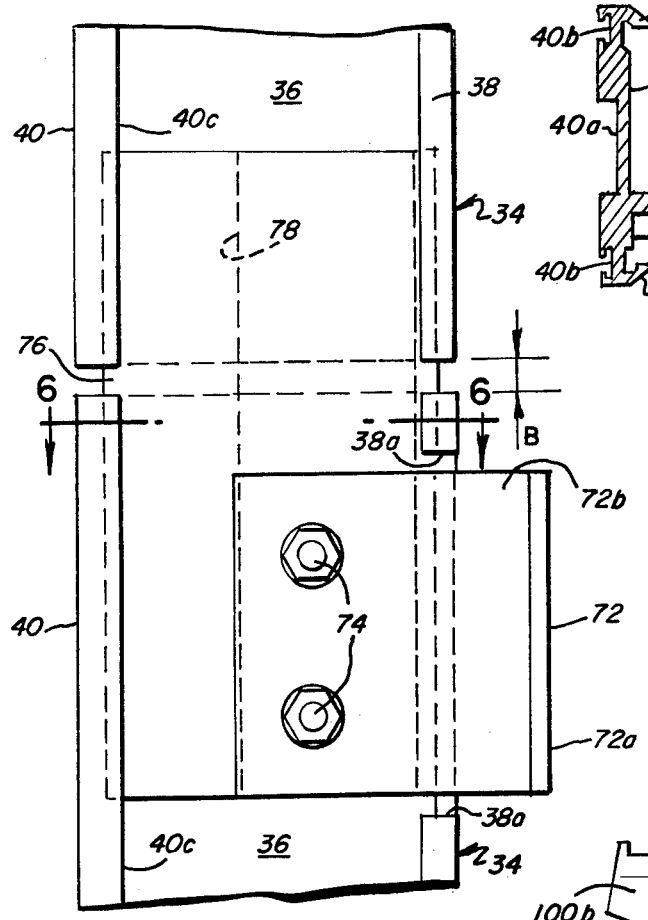
FIG. 5 is a fragmentary, vertical, sectional view taken substantially along lines 5—5 of FIG. 1.
Figure 6:
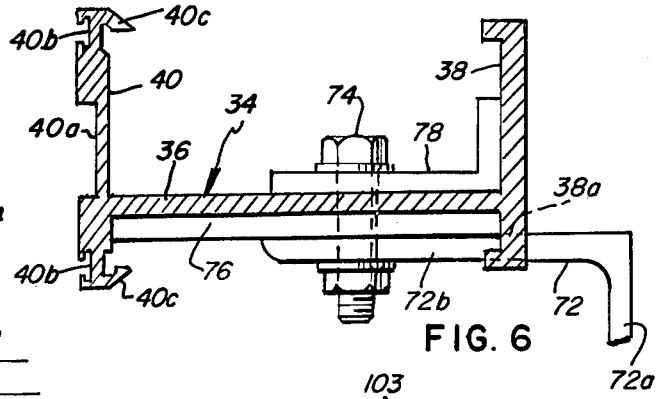
FIG. 6 is a fragmentary, vertical, sectional view taken substantially along lines 6—6 of FIG. 5.
Figure 9:
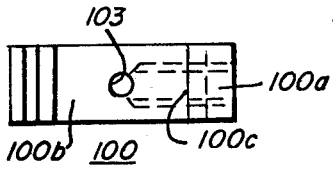
FIG. 9 is a top plan view of the chair.
Figure 7:
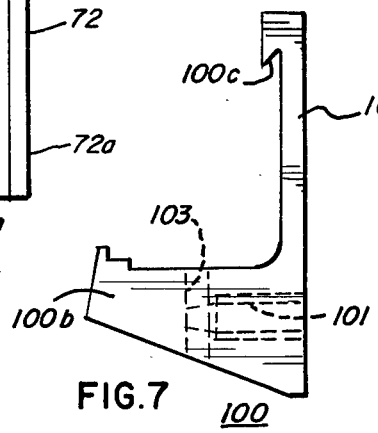
FIG. 7 is an enlarged, side, elevational view but illustrating a mullion support chair in accordance with the invention.
Figure 8:
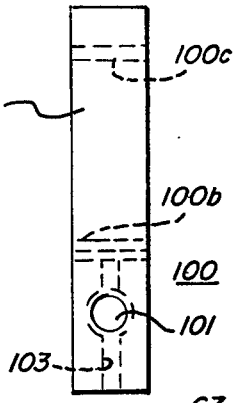
FIG. 8 is an inside face elevational view of the chair.

Referring to FIGS. 1, 5 and 6, when the vertical jambs or intermediate mullions 22 and 24 are of relatively great length in a multi-story building, for example, it may be necessary to provide an end to end splice between upper and lower members because of length limitations. Because the inside structrual elements 34 of the vertical mullions 22 and 24 carry the wind load and dead load of the wall structure 20, these elements are interconnected to the structure of the building at intervals preferably adjacent the points of an end to end splice.

For this purpose, an angle bracket 72 having one flange 72*a* secured to the building structure and an outwardly extending flange 72*b* is provided adjacent the upper end of a lower structural element 34 as illustrated in FIG. 5. A portion of the inside wall 38 on the narrow side with respect to the web 36 is cut away as at 38*a* in order to accommodate the flange 72*b* which is secured to the web 36 by a pair of nut and bolts 74 vertically spaced apart and extending through holes provided in the web. The web of the lower member 34 is sandwiched between a pair of splice members 76 and 78 and is secured by the nut and bolts which extend through holes formed in the splice member. The flat splice member 76 is dimensioned to fit closely between the inside and outside walls 38 and 40 and extends upwardly beyond the lower element 34 to contact the web and walls of the upper element in end to end alignment. The splice element 78 is of angle shaped cross-section and likewise extends above the lower element 34 to engage the web and wall 38 of the upper element on opposite sides. The upper portions of the splice elements thus restrain laterally transverse relative movement between the upper and lower elements and thus maintain precise vertical alignment, yet the upper element is permitted to move vertically with respect to the lower element and the end to end spacing indicated as "B" in FIG. 5 may vary.

Figure 2:
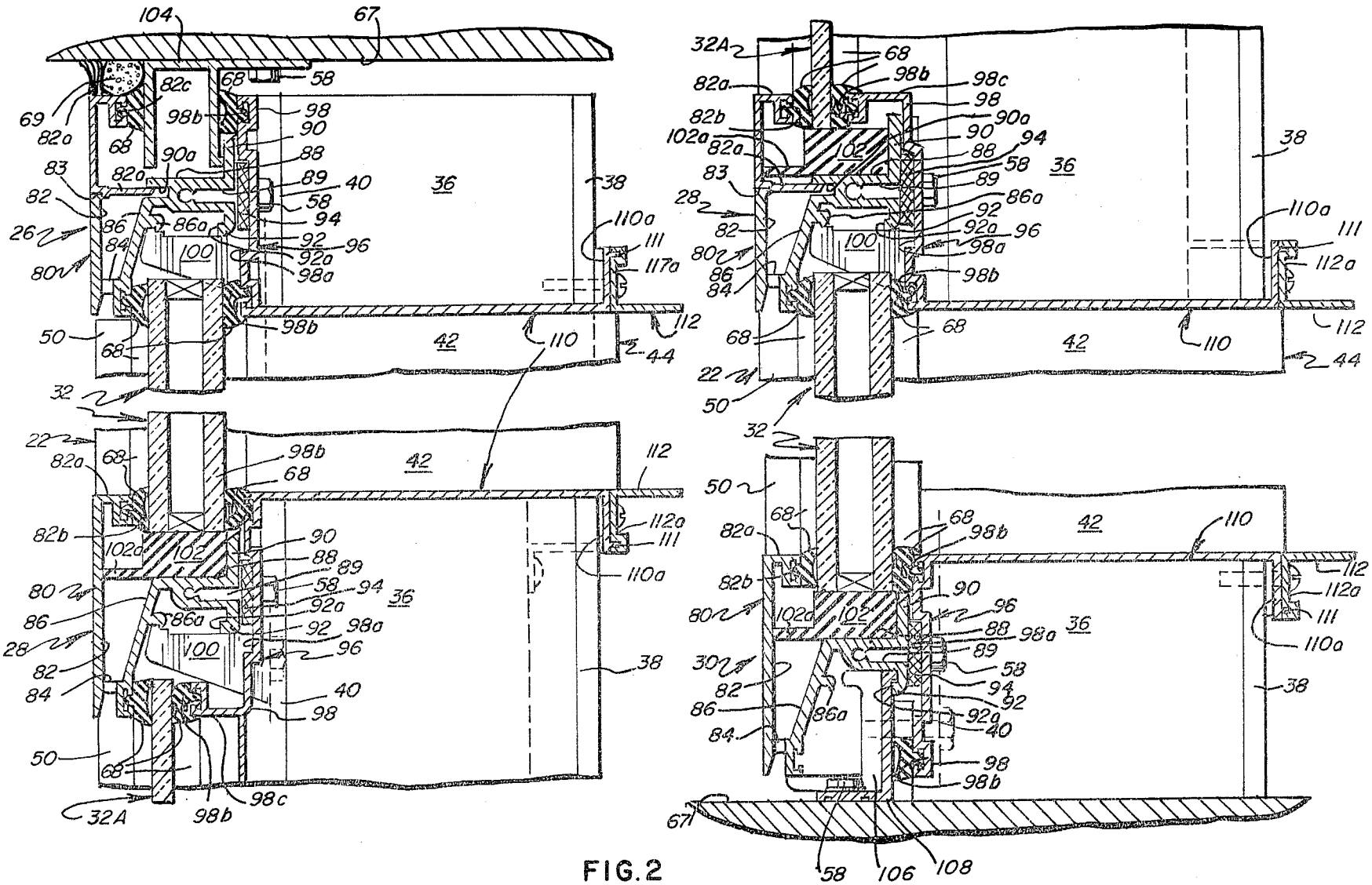
FIG. 2 is an enlarged vertical, sectional view taken substantially along lines 2—2 of FIG. 1.

Referring now to FIGS. 1 and 2, the horizontal mullions 24, 26 and 28 include an outer structural glazing element 80 which runs past the vertical inside members 34. The elements 80 have a relatively wide, flat, outer face 82 with an upper edge portion 82*a* having a recess 82*b* on the inwardly facing surface thereof for accommodating a weatherstrip 68. In addition, the horizontal glazing elements 80 have an integrally formed internal web structure including a bottom wall 84 having weep openings therein at longitudinal intervals, an inwardly and upwardly sloping wall 86 and an inwardly extending, relatively thick, horizontal tongue 88 having a recess 89 in the inner edge for receiving the threaded shanks of cap screws 58.

Along the upper side of the inner edge, the horizontal tongue 88 is provided with an upstanding vertical dam 90 having a beveled upper edge and this dam prevents any water collecting on the horizontal tongue from flowing over inwardly into the interior of the building. In this connection, it should be noted that the beveled upper edge of the dam is sloped outwardly and downwardly so that any moisture condensation passing downwardly into the interior of the mullion assembly from the inside face of the glazing panels 32 is channeled outwardly to eventually flow out the weep holes in the bottom wall 84.

The integrally connected sections 84, 86, 88 and 90 of the internal web structure act as a gutter for collecting and draining any condensation or leakage moisture and directing the moisture outwardly into the external atmosphere through the weep openings. In this connection, it should also be noted that the lower edge of the outer face 82 of the glazing element 80 extends below the level of the weep openings so that a venturi-like action is provided by wind forces to help draw out and drain any moisture that has been collected via the weep holes which are spaced at appropriate intervals along the length of the outer glazing element.

It should also be noted that the outside horizontal glazing elements 80 are structural members and are continuous across the outer surface of the outer wall 40 of the inside structural members 34 of the vertical mullions except where practicalities limit the overall length of the horizontal members. The vertical, outside mullion glazing elements 50 are cut to fit against the respective lower and upper surfaces of the horizontal glazing elements 80 when the wall structure is in place as shown in FIG. 2.

The internal web structure of the outer horizontal glazing elements 90 is provided with an L-shaped vertical flange structure joined to the underside of the horizontal tongue 88 along the inner edge and this flange structure includes an outwardly extending horizontal lip **92*a* spaced apart and below the underside of the tongue. The continuous elongated slot or recess 89 opens inwardly and is adapted to receive the threaded shanks of the cap screws 58 provided at periodic intervals along the length of the horizontal mullions. The threaded shanks thereof extend through holes formed in heat insulating spacers 94 which separate the outer glazing elements 80 of the horizontals from elongated inside glazing elements 96** secured thereto by the cap screws and heat insulating spacers. The cap screws and spacers may be installed at the factory at suitable longitudinal intervals along the length of the inside glazing elements or may be installed at the job site.

The inside horizontal members 96 are supported by glazing elements 80 and are cut to length and butt fitted against the outer surfaces of the opposite sidewalls 42 of the vertical covers 40. The inside horizontal glazing elements include a relatively wide vertical face 98 having a central groove or recess **98*a* in the outwardly facing surface for seating the spacers 94 and along upper and lower edge portions narrow grooves 98*b* are provided for accommodating the weatherstrips or sealing gaskets 68 which bear against the inside surface of the glazing panels 32 or 32A**.

The horizontal mullions 26, 28 and 30 are designed to accommodate both dual thickness glazing panels 32 and single thickness glazing panels 32A. Referring to FIG. 2, as an example, the upper glazing panels may be dual thickness panels, the intermediate glazing panels may be single thickness glazing panels, and the lower panels may be dual glazed. The mullion 28 includes a modified form of inside glazing element 96 with an outwardly extended wall segment **98*c* transversely of the main portion 98 being provided to accommodate the reduced thickness of the single pane glazing panels. The additional spacing provided by the wall portion 98*c* is dimensioned to fill the space which would otherwise be occupied by the thicker insulating glass panels. The elements 96 may include a pair of wall portions 98*c* on opposite sides of the recess 98*a* in order to accommodate a single thickness glazing panel 32A** both above and below the horizontal mullion.

In accordance with the present invention, the vertical structural load of the wall construction 20 is supported mainly by the inside structural elements 34 of the respective vertical mullions 22 and 24. The horizontal structural loading of the horizontal mullion 26, 28 and 30 is carried mainly by the outer glazing elements 80 which include the vertical outer face 82 and the integral web structure including portions 84, 86, 88, 90 and 92 as previously described. The outer glazing element of the horizontal mullions run past and are supported from the outer wall 40 of the inside structural members 34 of the vertical mullions and for this purpose, as best shown in FIGS. 2, 7, 8 and 9, there is provided a support chair or saddle 100 having a vertically extending leg portion **100*a* which is seated against the surface face of the channel spaced recess 40*a* in the outer wall 40 as shown in FIG. 2. The support chairs also include an outwardly extending arm 100*b* having an upper surface portion profiled as illustrated and adapted to receive and interlockingly support the lower flange section 92*a* and a rib structure 96*a* of the outside horizontal glazing element 80. The vertical leg 100*a* of the chair includes an outwardly projecting finger 100*c* at the upper end and the fingers interlock with the beveled upper edge of the dam 90 to firmly secure the outside glazing elements in place as shown. In the interlocked position as shown, the outer end portion of the chair arm 100*b* supports the rib 86*a* of the inwardly and upwardly sloping web segment 86 and the inner end of the arm supports the flange lip 92*a***.

The outside horizontal glazing elements 80 are initially applied onto the supporting chairs 100 with the element in a titled position so that the beveled upper edge of the dam 90 fits beneath the sloped lower edge of the finger **100*c* at the upper end of the vertical leg 100*a*** of the chair. The element is then rotated in a counterclockwise direction from this position into the seated position and is then firmly interlocked in place.

The vertical loading on the outer portion of the horizontal glazing elements 80 helps maintain the elements firmly in the interlocked position on the chairs 100 which in turn are supported by the outer wall 40 of the inside vertical structural element 34. Thus, the vertical and horizontal members of the wall structure 20 are structurally interconnected by the chairs 100 and heat transfer between the outside horizontal 80 and the inside verticals 34 is minimal because of the relatively small area of contact afforded by the chairs. The chairs are secured to the walls 40 of the inside verticals 34 with the cap screws 58 which extend through the keyhole shaped openings 41 with the threaded shanks of the cap screws engaged in a threaded bore 101. Each chair also includes a vertical bore 103 for use when the horizontals are spliced end to end.

The outer horizontal elements 80 may also be formed in two separate pieces which are joined together along a line 83 (FIG. 2) at about a mid-level on the outer face 82. These split type horizontal elements include an inwardly extending tongue 82*a* which projects into a recess 90*a* provided in the tongue portion 90 of the web structure. As illustrated in FIG. 2, the glazing panels 32 and 32A are supported on glazing blocks 102 having an outwardly extending finger 102*a* which bears against the inside surface of the outer wall 82 and this finger helps to secure the split type horizontal element in place as illustrated.

The horizontal head and sill mullions 26 and 30 (FIG. 2) are interconnected with the adjacent surfaces 67 of the building structure as shown in FIG. 2 and at the head, a channel-like extension 104 having spaced apart depending legs is secured to the building surface with suitable fasteners 58 so that the legs cooperate with adjacent portions of the dam 90 and the outer wall 82 to accommodate sealing strips 68 and gun applied caulking material 69.

Figure 15:
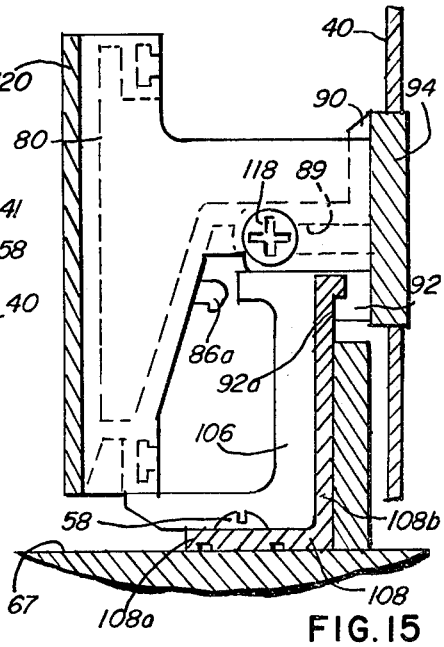
FIG. 15 is a fragmentary, vertical, sectional view similar to FIG. 11 but illustrating an end splice along a sill of the framework.
Figure 12:
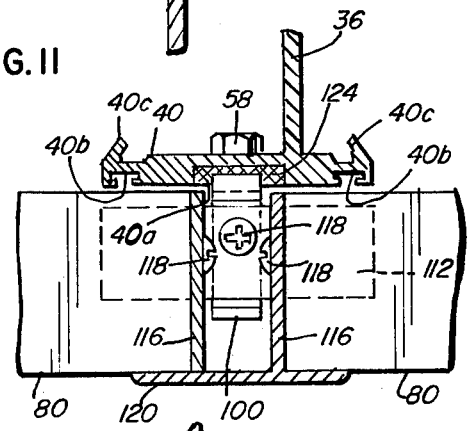
FIG. 12 is a fragmentary, horizontal, sectional view taken substantially along lines 12—12 of FIG. 11.
Figure 14:
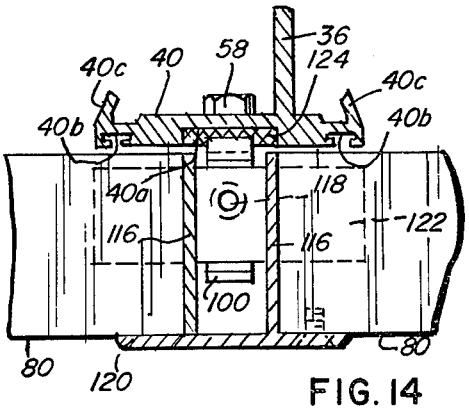
FIG. 14 is a fragmentary horizontal, sectional view taken along lines 14—14 of FIG. 13.

At the sill, the horizontal outside member 80 is supported on L-shaped clips 106 provided on an angle strip 108 having a lower flange 108*a* anchored to the building floor surface 67 with fasteners 58 and an upstanding flange 108*b* which is interlocked with the flange lip 92*a* as best shown in FIG. 15. This arrangement firmly secures the sill mullion in place along the floor level and the angle 108 provides a dam which prevents water from seeping onto the building floor from outside the wall structure.

The horizontal mullions 26, 28 and 30 are well adapted to neatly interface with interior building components such as floors, ceiling systems, ventilators, fan and cooling units and the like, and for this purpose, the inside elements 96 may include integral, inwardly extending wall sections 110 having vertical flanges 110*a* along an inner edge. These flanges include a key or rib 111 and are adapted to abutt in interfitting relation with flanges 112*a* of various different types of building elements 112. When the flanges are interconnected as illustrated in FIG. 2, the result is a smooth, neat interface between the glazing elements 96 and the interior building components represented by the wall or cover members 112.

Referring now to FIGS. 1 and 10–16, the horizontal mullions 26, 28 and 30 may require end to end splices when of sufficient length and the splices provide a means for accommodating longitudinal expansion and contraction which is of greater importance with the intermediate mullions 28 because of the exposure to greater variations in temperature.

Figure 10:
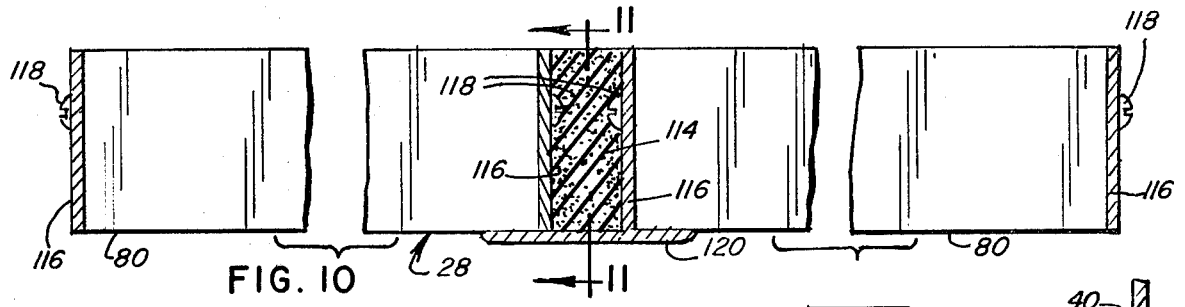
FIG. 10 is a top plan view of a horizontal mullion taken along lines 10—10 of FIG. 1 showing an end splice.

In order to accommodate the longitudinal movement between end to end splices in the horizontal, a sponge-like pad 114 is interposed between end caps 116 mounted on the adjacent ends of the outside horizontal elements 80 by means of threaded screws 118 with shanks threaded into the blind end of the tongue slot 89. As the elements 80, aligned in end to end relation as shown in FIG. 10, begin to move back and forth longitudinally, the pads 114 expand and contract in thickness to fill the void between the end caps 116. At each splice, one of the adjacent end caps is formed with an outer plate or cover 120 which overlaps the joint in front of the pad.

Figure 11:
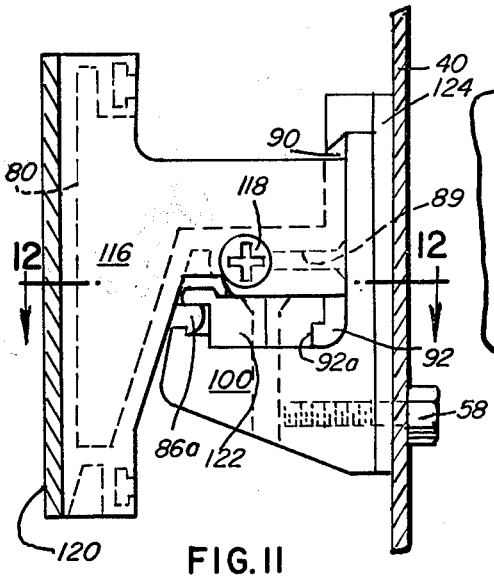
FIG. 11 is a fragmentary, vertical, sectional view taken substantially along lines 11—11 of FIG. 10.
Figure 13:
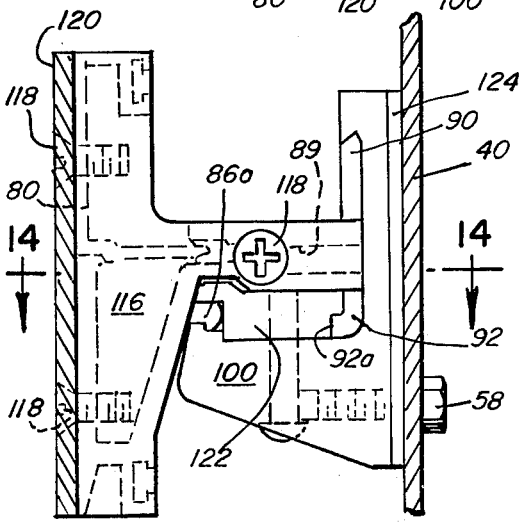
FIG. 13 is a fragmentary, vertical, sectional view similar to FIG. 11 but illustrating an end splice in a horizontal framing member along the head of the framework.
Figure 16:
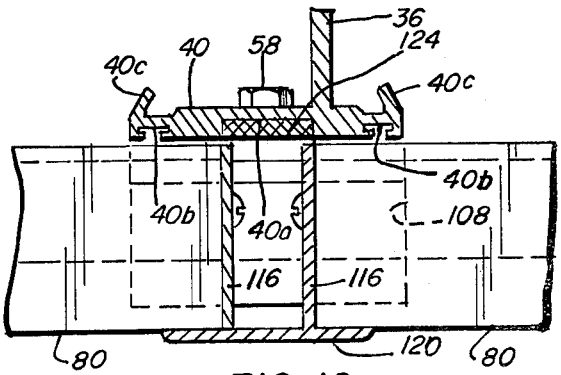
FIG. 16 is a fragmentary, horizontal, sectional view of an end splice along the sill of the framework.

The end to end splices in the horizontals are positioned adjacent a vertical mullion, so that a single chair 100 or clip 106 may be utilized to support the adjacent ends of the outside glazing elements 80 by means of a splicer block 122 secured to the chair with a screw 118 extending into the vertical bore 103 thereof. As illustrated in FIGS. 11 and 13, the splices are formed with a cross-section designed to key-fit on the underside of the tongues 88 with the flange lips 92*a* and ribs 86*a*. This arrangement maintains axial alignment between adjacent, end to end glazing elements 80 while permitting longitudinal relative movement therebetween.

As illustrated, the vertical legs 100*a* of the chairs 100 are mounted in a groove provided in heat insulating spacer blocks 124 and in turn, the horizontal leg 106*b* of a chair supports a splicer block 122 extending laterally outwardly in opposite directions to carry the ends of the glazing elements 80.

When erecting the wall structure 20, the elements 104 and 108 are secured to the building wall surfaces 67 and then the inside vertical members 34 are set in place. Next, the chairs 100 and 106 are installed and the outer horizontal elements 80 are mounted thereon to form the structural frame. After each outer horizontal element 80 is secured in place, an outer vertical glazing element 50 is attached in place as described and when all of the outer vertical elements at one level are in place, the next outer horizontal member 80 is instilled. This process is repeated until the framework is assembled, and then the inside horizontal glazing elements 96 are attached and butt fitted between the vertical mullions. The cap screws 58 are left in a loosened condition until the glazing panels are installed and are then tightened to press the sealing gaskets 68 against the opposite faces of the panels. Tightening of the cap screws as well as the installation of the glazing panels is accomplished from the interior of the building and the unique design of the directly facing inside and outside wall portions of the respective horizontal and vertical mullions provides good sealing pressure on the gaskets to thereby better preclude water and air infiltration.

Although the present invention has been described with reference to several illustrated embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. A framing member for a wall construction including one or more glazing panels comprising:

an elongated structural element having an outwardly facing outer wall with a longitudinal recess along the center of an outer face thereof and an inwardly extending wall joined to said outer wall along a line offset from the center, an elongated glazing element having an outer face parallel of said outer wall forming at least one glazing pocket therebetween for receiving an edge portion of one or more glazing panels, said element including a tongue extending inwardly of said outer face toward said recess and forming a wall, said flange having a longitudinal groove along an inside edge of said glazing pocket; and fastening means for securing said glazing element and said structural element together with said tongue aligned, said fastening means including a spacer of heat insulating material having a head seated in said recess and a tongue at right angles thereto seated in said groove, and a screw fastener having a head on the inside of said outer wall and a threaded shank extended therethrough into threaded engagement within said groove of said tongue.

2. The frame member of claim 1 wherein said glazing element includes an inwardly extending wall parallel of said tongue joined to said outer face.

3. The frame member of claim 1 wherein said outer wall is formed with a shaped opening having an upper portion dimensioned to pass said head of said screw fastener and a smaller lower portion dimensioned to pass said shank but not pass said head portion.

4. The frame member of claim 3 wherein said spacer is formed with an opening and said shank of said screw fastener extends through said spacer opening.

5. The frame member of claim 1 wherein said outer wall includes a pair of connectors along inner surfaces thereof adjacent the outer edges and a cover member for enclosing said inwardly extending wall and the head of said fastener adapted to be interconnected along said connectors.

6. The frame member of claim 5 wherein said cover includes opposite sidewalls parallel of said inwardly extending wall having connector means along outer edges adapted to snappingly engage said connectors.

7. The frame member of claim 1 wherein said glazing element includes an inner wall spaced and parallel of said outer face joined to said tongue; said inner wall, said tongue and said outer face forming the walls of at least one glazing pocket.

8. The frame member of claim 4 wherein said inner wall of said glazing element extends laterally outwardly in opposite directions from said tongue.

9. The frame member of claim 7 wherein said inner wall and said outer face including oppositely facing grooves adjacent the outer edges, and resilient seal strips in said facing grooves for sealing engagement against opposite faces of said glazing panel.

10. A wall construction comprising a framework for holding one or more glazing panels, comprising:

at least one vertical mullion comprising an inside load supporting elongated structural member having an outer wall and an outside elongated glazing member supported therefrom and cooperating to form a pair of glazing pockets on laterally opposite sides of said mullion for receiving edge portions of glazing panels, at least one horizontal frame member comprising an outside, load supporting, elongated, structural member extending transversely across said outer wall of said inside structural member of said vertical mullion and an inside horizontal, elongated, glazing member supported by said outside horizontal structural member and cooperating therewith to form a pair of upper and lower glazing pockets for receiving edge portions of glazing panels, and support chair means mounted on said outer wall of said inside vertical structural member including an outwardly extending arm supportively engaging said outside horizontal structural member.

11. The wall construction of claim 10 wherein said inside structural member and said outside glazing member of said vertical mullion are interconnected with at least one elongated screw fastener having a threaded shank extending outwardly through said outer wall to engage and support said chair means, said fastener having a head on the inside of said outer wall of said inside structural member.

12. The wall construction of claim 11 wherein said outer wall is provided with a shaped opening therein having an enlarged upper portion dimensioned to pass a head of said fastener and a narrow lower portion dimensioned to pass the shank of said fastener but not pass said head.

13. The wall construction of claim 10 wherein said outside horizontal structural member includes an inwardly facing edge portion and said support chair means is formed with a recess for receiving said edge portion in interlocking engagement preventing upward movement of said edge portion above said support chair means when interlocked therewith.

14. The wall construction of claim 13 wherein said outside horizontal structural member includes a tongue having a pair of vertically spaced apart inwardly facing edge portions forming a recess therebetween opening inwardly, and headed fastener means including a shank extending through an opening in said inside horizontal glazing member into said tongue recess for interconnecting said inside and outside horizontal members.

15. The wall construction of claim 14 wherein said inside glazing member includes a deflectable element having an outer edge portion adapted to engage a portion of said outside horizontal structural member for holding said horizontal members in position in interconnected condition.

16. The wall construction of claim 14 including a heat insulating spacer having a tongue extending into said recess of said tongue of said outside horizontal member.

17. The wall construction of claim 10 including a heat insulating spacer between said inside structural member and said outside glazing member of said vertical mullion and fastening means extending through said spacer for interconnecting said vertical members to form said glazing pockets.

18. The wall construction of claim 17 including a heat insulating spacer between said outside structural member and said inside glazing member of said horizontal member and said fastener means extends through said spacer interconnecting said horizontal members to form said glazing pocket.

19. The wall construction of claim 18 wherein said horizontal outside structural member includes upper and lower edge surfaces and said vertical outside glazing member includes an end adapted to be butt fitted against one of said surfaces.

20. The wall construction of claim 19 wherein said vertical inside structural member includes means defining one or more opposite side walls and said horizontal inside glazing member includes an end adapted to be butt fitted against at least one of said side walls.

* * * * *